US006457268B1

(12) United States Patent
Perry et al.

(10) Patent No.: US 6,457,268 B1
(45) Date of Patent: Oct. 1, 2002

(54) EDGE PROTECTION ASSEMBLY FOR AN IMPLEMENT OF A WORK MACHINE

(75) Inventors: William C. Perry, Morton; William J. Renski, Peoria, both of IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/747,059

(22) Filed: Dec. 22, 2000

(51) Int. Cl.[7] ..... E02F 3/76
(52) U.S. Cl. ..... 37/403; 37/446; 37/903
(58) Field of Search ..... 37/403, 407, 406, 37/404, 446, 448, 450, 451–455, 903

(56) References Cited

U.S. PATENT DOCUMENTS

| | | | | |
|---|---|---|---|---|
| 1,655,135 A | | 1/1928 | Crawford | |
| 1,748,359 A | | 2/1930 | Miley | |
| 2,932,100 A | | 4/1960 | Goethe | |
| 3,107,445 A | | 10/1963 | Ratkowski | |
| 3,497,973 A | | 3/1970 | Campbell | |
| 3,550,293 A | | 12/1970 | Helton | |
| 3,851,413 A | * | 12/1974 | Lukavich | 37/403 |
| 4,407,081 A | | 10/1983 | Hanson | |
| 4,413,432 A | | 11/1983 | Bierwith | |
| 4,414,764 A | | 11/1983 | Johansson et al. | |
| 4,729,180 A | | 3/1988 | Hendricks | |
| 4,932,145 A | | 6/1990 | Reeves, Jr. | |
| 5,016,365 A | | 5/1991 | Robinson | |
| 5,152,087 A | | 10/1992 | Maguina-Larco | |
| 5,275,470 A | | 1/1994 | Miller | |
| 5,415,236 A | | 5/1995 | Williams | |
| 5,553,409 A | | 9/1996 | Irving | |
| 5,634,285 A | | 6/1997 | Renski | |
| 5,743,031 A | | 4/1998 | Launder et al. | |
| 5,794,370 A | * | 8/1998 | Haagenstad et al. | 37/404 |
| 5,852,888 A | | 12/1998 | Cornelius | |
| 6,070,345 A | * | 6/2000 | Akaki et al. | 37/407 |

* cited by examiner

*Primary Examiner*—Robert E. Pezzuto
(74) *Attorney, Agent, or Firm*—Wood Herron & Evans, LTD; James R Smith

(57) ABSTRACT

A protection assembly for protecting the base edge and an attached cutting edge of a bucket or other implement of a work machine. The protection assembly is readily attachable and detachable to buckets having both new and worn base and cutting edges when the use of teeth is required for excavating, especially in hard packed virgin soil. The protection assembly includes a digging plate and a cover plate that form an elongated edge recess for receiving the base and cutting edges of the bucket. Positioning devices are provided on the bucket and the protection assembly to consistently position the protection system at the same location on the bucket regardless of the amount of wear on the base and cutting edges. The positioning devices prevent movement of the protection system relative to the bucket when the bucket is used for excavating.

27 Claims, 4 Drawing Sheets

EDGE PROTECTION ASSEMBLY FOR AN IMPLEMENT OF A WORK MACHINE

TECHNICAL FIELD

The present invention relates generally to an implement of a work machine, and more particularly to a protection assembly for the base and cutting edge assemblies of an implement of a work machine.

BACKGROUND ART

A work machine, such as an excavator, may include an implement such as a bucket for moving, excavating, or grading dirt or other types of material. The shape of the bucket, especially its base edge, contributes to the effectiveness of the work machine in performing these tasks.

A straight base edge of the bucket is generally preferred for moving loose materials so that the base edge can scrape material close to an underlying surface without causing damage to the underlying surface. For example, a pile of gravel that is to be moved may lie upon packed soil or asphalt. In addition, the straight base edge may perform adequately for excavating in some situations.

In many instances it is desirable to attach a cutting edge to the base edge to protect the base edge from wear, thus extending it's life. The base and cutting edge combination function in essentially the same manner as a bucket having only a base edge and is intended for loading loose material and not necessarily for the excavation of material.

By contrast, a bucket having a toothed base edge is generally preferred when excavating, especially in hard-packed virgin soil. The toothed base edge is better suited for penetrating the hard-packed soil. Moreover, the teeth may be provided sufficient strength to minimize damage during excavating, whereas a straight base edge tends to wear and bend.

So it can be seen that a single bucket will not necessarily be appropriate for all applications. The bucket having teeth will out perform the bucket having a base edge or base edge/cutting edge combination in excavation applications while the bucket having just a base edge or base edge/cutting edge combination, will be preferred during loading applications.

In order to alleviate the need for having two separate buckets to perform efficiently, it has been known to attach a tooth bar over the base edge of a bucket to temporarily provide that bucket with teeth for excavation. Typically, a tooth bar can be attached to the sides of a bucket by a pair of bolts and may be easily removed or attached depending on the type of work.

Individually mounting teeth to the base edge is generally known. However, exposed portions of the base edge are still subject to wear and damage. In addition, mounting and removing each tooth from the bucket requires a significant amount of time.

In some instances, tooth bars are used that surround and protect just the base edge of the bucket. Teeth are attached at intervals along the tooth bar to form a tooth bar assembly.

Conventionally, tooth bars must substantially contact the base edge along the length of the base edge in order to transfer the loads encountered and thus to avoid damaging the tooth bar, its attachments to the bucket, or the base edge. A slotted hole in mounting brackets of the tooth bar assembly allows for adjusting the position of the tooth bar assembly to achieve this contact. A bolted connection through a hole in the bucket and the slotted hole in the mounting bracket is used to maintain this positioning.

While it is typical to use a bolted connection to attach the tooth bar assembly to the bucket, it may be preferable to use a pinned connection in some instances. A pinned connection may utilize a pin having a diameter that may carry a larger load than a bolt and may decrease the installation time required by bolted connections.

The present invention is directed to overcoming one or more of the problems or disadvantages associated with the prior art.

DISCLOSURE OF THE INVENTION

While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, there is provided a protection assembly for protecting the base edge and an attached cutting edge of a bucket or other implement of a work machine. The bucket has a pair of upright side walls and a bottom wall that extends therebetween and terminates in a base edge subject to wear. The cutting edge is attached to an underside of the bucket bottom wall adjacent the base edge. In accordance with one aspect of the present invention, the protection assembly includes a digging plate adapted to be positioned adjacent an underside of the cutting edge and a cover plate operatively connected to the digging plate to form an elongated edge recess that is adapted to receive the base and cutting edges of the bucket. A plurality of teeth are forwardly disposed along the digging plate.

A pair of spaced apart mounting brackets are positioned adjacent opposite ends of the elongated edge recess and are configured to reside within the upright side walls of the bucket. Each mounting bracket has a mounting aperture, such as an elongated slot, that is adapted to register with a mounting aperture formed in each of the bucket side walls. Fasteners extend through the mounting apertures formed in the bucket side walls and mounting brackets to secure the protection assembly to the bucket. Locking members may be provided to prevent fore and aft movement of the protection assembly relative to the bucket.

In accordance with another aspect of the present invention, a pair of spaced apart elongated lug members are operatively connected to the bucket bottom wall and extend forwardly from the base edge. A pair of spaced apart recesses are formed in the cover plate for receiving and engaging forwardly extending portions of the lug members to position the edge recess relative to the base edge of the bucket when the protection assembly is attached to the bucket.

The protection assembly further includes a pair of spaced apart retaining members operatively connected to at least one of the digging plate and the cover plate for forming rearwardly facing throats with the recesses formed in the cover plate. The rearwardly facing throats are adapted to receive the forwardly extending portions of the lug members. When the forward portions of the lug members are inserted into the rearwardly facing throats, and the fasteners are inserted to secure the mounting brackets to the bucket side walls, the protection assembly is consistently positioned at the same location on the bucket regardless of the amount of wear on the base edge or cutting edge.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

BEST MODE FOR CARRYING OUT THE INVENTION

Figure 1:
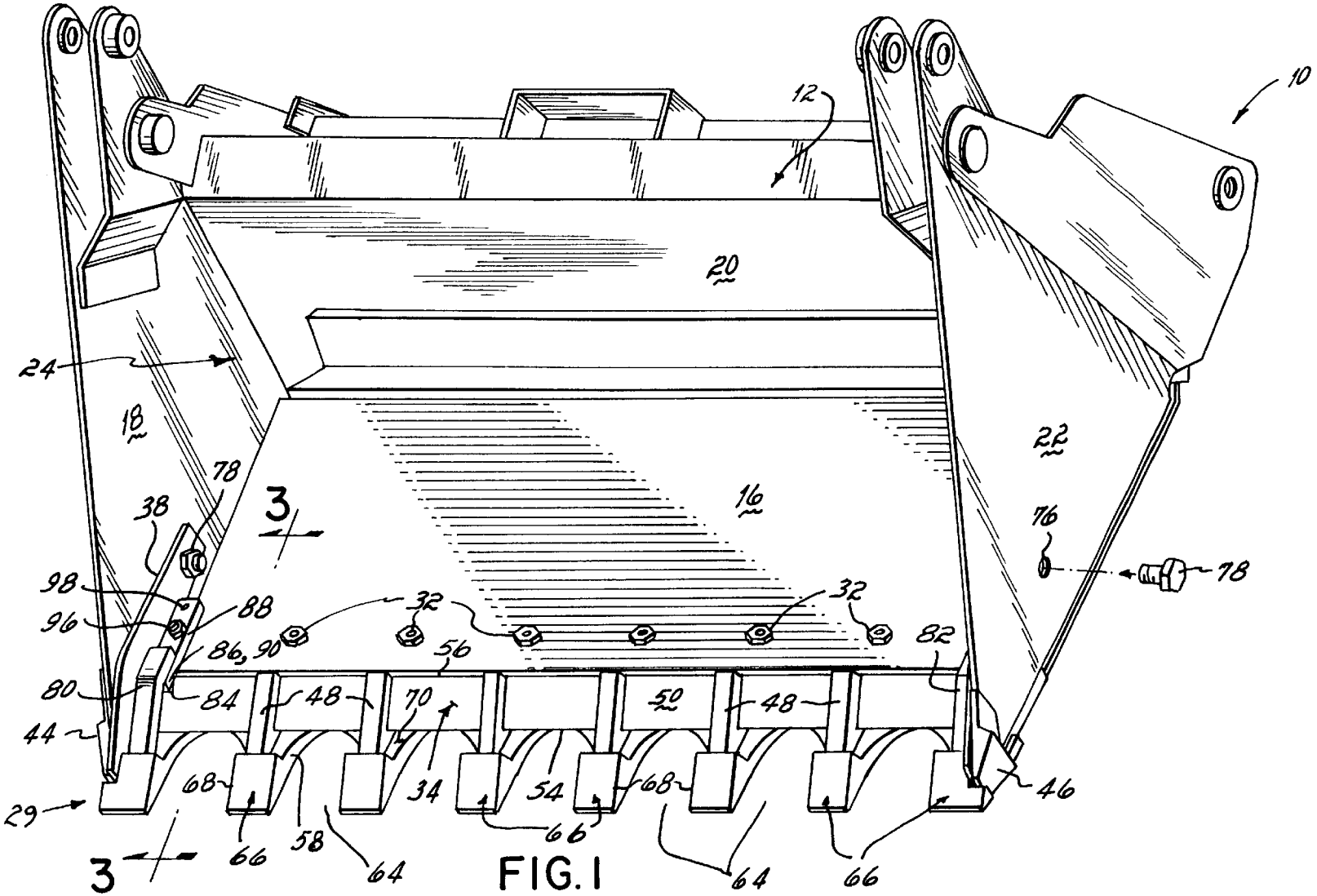
FIG. 1 is a perspective view of a protection assembly secured to base and cutting edges of the bucket assembly in accordance with the principles of the present invention.
Figure 2:
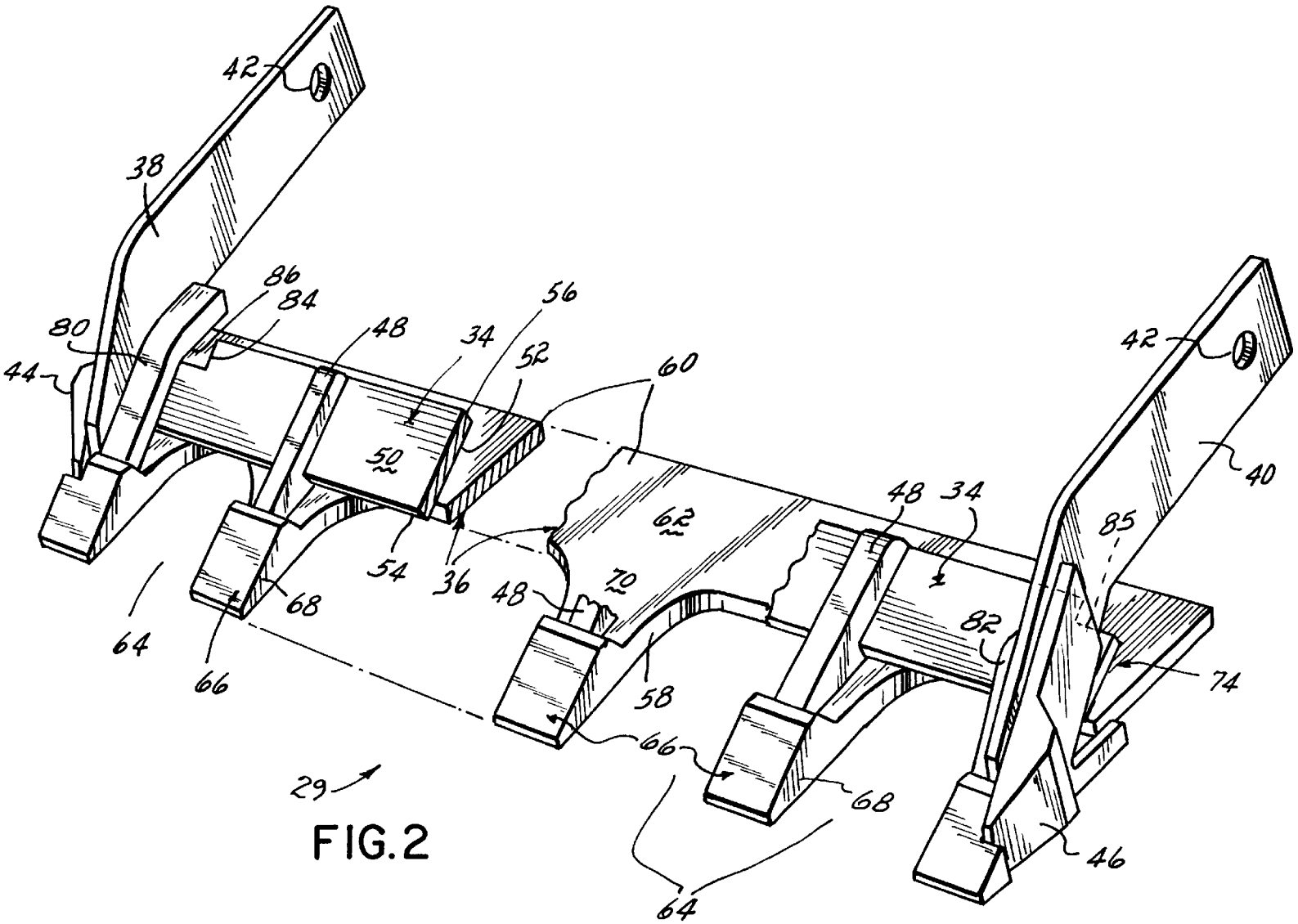
FIG. 2 is a perspective and partially cutaway view of the protection assembly of FIG. 1.

Referring to FIGS. 1 and 2, there is shown an implement assembly 10, specifically a bucket assembly, which is consistent with aspects of the present invention. Implement assembly 10 includes a bucket 12, a bottom wall 16, right side wall 18, back wall 20, and left side wall 22, defining a bucket cavity 24. A base edge 26 is formed along the forward, leading edge of the bottom wall 16 and interposed between the upright bucket side walls 18, 22. A cutting edge 28 is attached to the base edge 26 and both are preferably sharp edged and straight in order to scrape when leveling a surface or loading loose material. However, both edges 26, 28 tend to be bent or worn during use. When excavating or digging, especially in hard-packed virgin soil, a toothed edge is desirable. Consequently, in accordance with the principles of the present invention, a protection assembly 29 having integrally formed teeth is mounted to the bucket 12 to enhance the ability of bucket 12 to perform excavating as well as providing protection to the base edge 26 and cutting edge 28.

Figure 3:
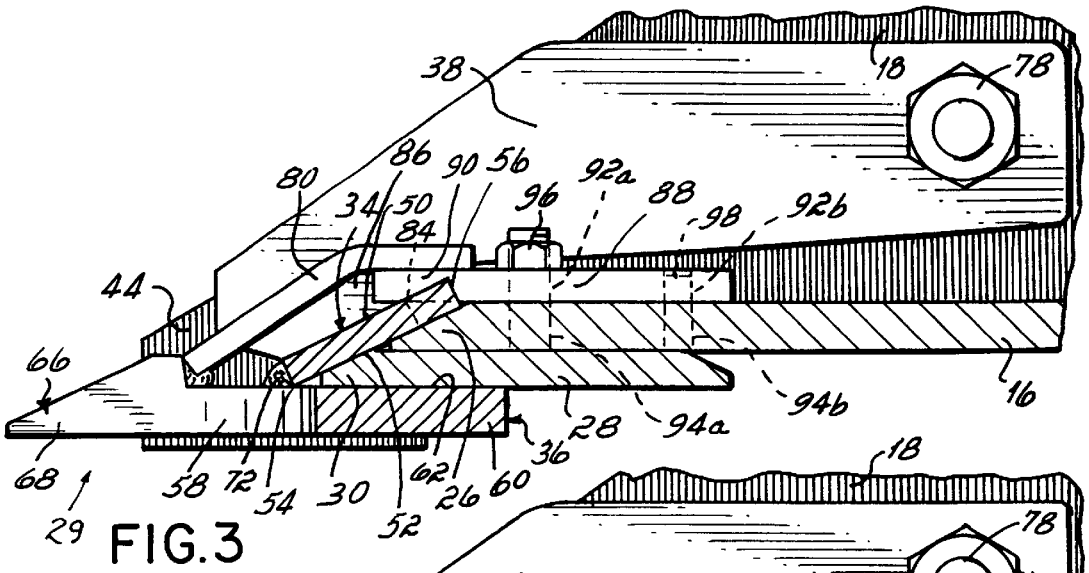
FIG. 3 is a cross sectional view taken along line 3—3 of FIG. 1 illustrating the protection assembly mounted on a new base edge and cutting edge of the bucket assembly.
Figure 4:
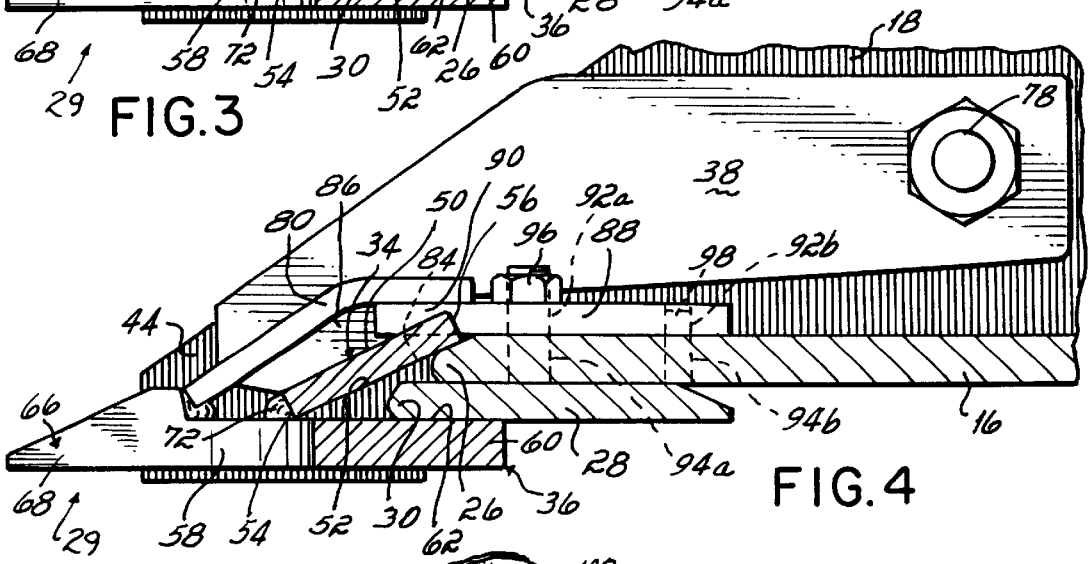
FIG. 4 is a view similar to FIG. 3 illustrating the protection assembly mounted on a worn base edge and cutting edge of the bucket assembly.

In accordance with one aspect of the present invention as shown in FIGS. 3 and 4, the cutting edge 28 is reversibly mounted to an underside of bucket 12 and includes an elongated cutting edge portion 30 that extends forwardly of the base edge 26. The bucket bottom wall 16 and reversible cutting edge 28 include aligned mounting holes (not shown) for receiving fasteners 32.

With particular reference to FIG. 2, the protection assembly 29, depicted removed from the bucket 12, includes a cover plate 34 and a digging plate 36 for protecting both the base edge 26 and the cutting edge 28 as described in detail below. The protection assembly 29 includes right and left mounting brackets 38, 40 having mounting apertures 42 (FIG. 2) formed therethrough. While mounting apertures 42 are illustrated as circular apertures, it will be appreciated by those of ordinary skill in the art that slotted apertures (not shown) are possible as well. Right and left end braces 44, 46 are mounted to opposite ends of the cover plate 34 and the digging plate 36. Structural support between the cover plate 34 and digging plate 36 is provided by a number of straps 48.

The cover plate 34 is configured to be positioned forward of the base edge 26 and cutting edge 28. In particular, the cover plate 34, illustrated as an elongated rectangular plate, includes an upper surface 50, a lower surface 52, an attachment edge 54, and an unattached edge 56.

The digging plate 36 is configured to be positioned adjacent an underside of the cutting edge 28. In particular, the digging plate 36 has a forward edge 58 and a rear portion 60 having an upper surface 62. The digging plate 36 has a number of notches 64 defined in the forward edge 58 so that a tooth 66 is formed from the portion of the digging plate 36 that is interposed between notches 64. For example, notches 64 may be flame cut into the forward edge 58. Each tooth 66 thus integrally formed from the digging plate 36 includes a forwardly extended "half arrow head" portion 68 connected to the rear portion 60 by a tooth support portion 70.

The cover plate 34 is attached at its attachment edge 54 to the digging plate 36 by a weld 72 such that the attachment edge 54 of the cover plate 34 contacts the upper surface 62 of the digging plate 36 behind the teeth 66. In particular, the cover plate 34 forms an elongated edge recess 74 with the digging plate 36 for receiving the base edge 26 of the bucket 12 and the cutting edge portion 30 of cutting edge 28. Specifically, the edge recess 74 is formed between the lower surface 52 of the cover plate 34 and the upper surface 62 of the digging plate 36. Each strap 48 is attached to the tooth support portion 70 and the upper surface 50 of the cover plate 34 to support the cover plate 34 relative to the digging plate 36.

Referring to FIGS. 1 and 2, the right mounting bracket 38 is attached proximate to the right end of the cover plate 34 and digging plate 36 and extends rearwardly to be mounted in contact with or closely adjacent with the inward side of the right bucket side wall 18. The left mounting bracket 40 is attached proximate to the left end of the cover plate 34 and digging plate 36 and extends rearwardly to be mounted in contact with or closely adjacent with the inward side of the left bucket side wall 22. Each bucket side wall 18, 22 is provided with a mounting aperture 76 (FIG. 1) to be aligned with respective mounting apertures 42 formed in the mounting brackets 38, 40 to receive fasteners 78.

The right and left end braces 44, 46 such as clevis shaped members as illustrated in FIG. 2, are attached to the opposite ends of the cover plate 34 and digging plate 36, thereby providing additional stiffening support to the protection assembly 29.

In accordance with another aspect of the present invention, each outermost tooth 66 includes a retention member, such as a right bent bar 80 and a left bent bar 82, that are attached to respective tooth support portions 70 and extend rearwardly over the cover plate 34 proximate to the opposite ends of the protection assembly 29. The bent bars 80, 82 may be formed from bending a straight piece of metal or formed from welding together two or more pieces of metal, for example.

The cover plate 34 further includes right and left positioning devices, such as recesses or notches 84, 85 (FIG. 2) formed in the unattached edge 56 that extend partially toward the attached edge 54. The positioning recesses 84, 85 and bent bars 80, 82 form rearwardly presented throats 86 (FIG. 2) for purposes to be described in detail below.

Referring to FIG. 1, a positioning member, such as a right mounting lug 88, is attached to the bucket bottom wall 16 proximate the right bucket side wall 18. The mounting lug 88 has a forward portion 90 that is adapted to be received in the right throat 86 of the protection assembly 29. Similarly, a left mounting lug (not shown) is attached to the bucket bottom wall 16 proximate the left bucket side wall 22 for receiving a forward portion of the left mounting lug in the left throat(not shown)of the protection assembly 29.

Referring to FIG. 3, the protection assembly 29 is illustrated attached to a new base edge 26 and cutting edge 28 of a bucket 12. A pair of spaced apart positioning devices, such as the mounting lugs 88, are mounted on the bucket bottom wall 16 and inwardly of the upright bucket side walls 18, 22. Each mounting lug 88 includes a pair of spaced apart apertures 92*a*, 92*b* that register with a pair of spaced apart apertures 94*a*, 94*b* (FIGS. 3 and 4) formed in the bucket bottom wall 16 and inwardly of the bucket side walls 18, 22. One of the mounting apertures 92*a* in each mounting lug 88 and one of the mounting apertures 94*a* in the bucket bottom wall 16 receives a fastener 96. The other mounting apertures 92*b* and 94*b* of the mounting lug 88 and bucket bottom wall 16, respectively, receive a dowel pin 98 (FIGS. 3 and 4).

The base and cutting edges 26 and 28 respectively, are subject to being dimensionally altered due to wear. For this reason, the mounting lugs 88 present the consistently placed forward portions 90 for positive engagement with the protection assembly 29. When the forward portions 90 of the mounting lugs 88 are inserted into the throats 86, and the fasteners 78 are inserted to secure the mounting brackets 38, 40 to the bucket side walls 18, 22, rearward movement of the protection assembly 29 relative to the bucket 12 is prevented by engagement between the mounting lugs 88 and the positioning recesses or notches 84, 85 formed in the cover plate 34. The cooperation between the mounting lugs 88 and the positioning recesses or notches 84 prevents upward movement of the protection assembly 29 relative to bucket 12 as well. Downward movement of the protection assembly 29 is prevented by cooperation of the mounting lugs 88 and the retention members 80, 82. Of course, those of ordinary skill in the art will appreciate that alternative structures to the positioning devices 80, 82, 84, 85 and 88 are possible for mounting the protection assembly 29 to the bucket 12 are possible while providing the same advantages without departing from the spirit and scope of the present invention.

Referring to FIG. 4, the protection assembly 29 is illustrated as being mounted on an implement assembly 10 that includes a worn base edge 26 and a worn cutting edge portion 30. When the forward portions 90 of the mounting lugs 88 are inserted into the throats 86, and the fasteners 78 connect the mounting brackets 38, 40 to the bucket side walls 18, 22, the protection assembly 29 is consistently positioned at the same location on the bucket 12 regardless of the amount of wear on the base edge 26 or the cutting edge portion 30.

Figure 5:
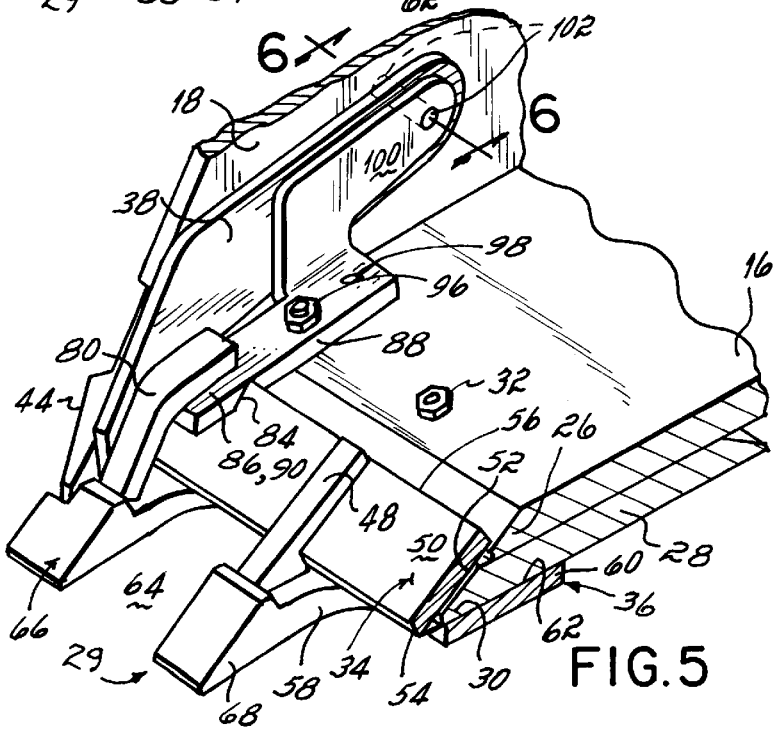
FIG. 5 is a partial perspective view of a protection assembly according to an alternative embodiment of the present invention.
Figure 6:
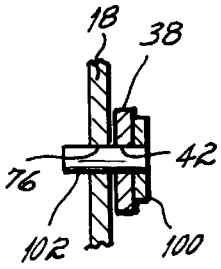
FIG. 6 is a cross sectional view taken along line 6—6 of FIG. 5 illustrating attachment of the protection assembly to the bucket side wall.

With reference now to FIGS. 5 and 6, an alternative attachment of the protection assembly 29 to the bucket 12 is shown. In particular, a lug plate 100 extends rearwardly from each mounting lug 88. An outwardly extending pin 102 is operatively connected to each lug plate 100 and passes through the mounting apertures 42 in the mounting brackets 38, 40 and the mounting apertures 76 in bucket side walls 18, 22. Additionally, the pin 102 may be threaded to receive a nut (not shown) on the outside of the bucket side walls 18, 22 to enhance locking of the mounting brackets 38, 40 between the lug plate 100 and the bucket side walls 18, 22. Sufficient clearance is provided in the positioning notches or recesses 84, 85 so that each mounting lug 88 may be received in the rearwardly extending throats 86 and the pins 102 may be inserted through mounting apertures 42, 76 in the mounting brackets and bucket side walls, respectively.

Figure 7:
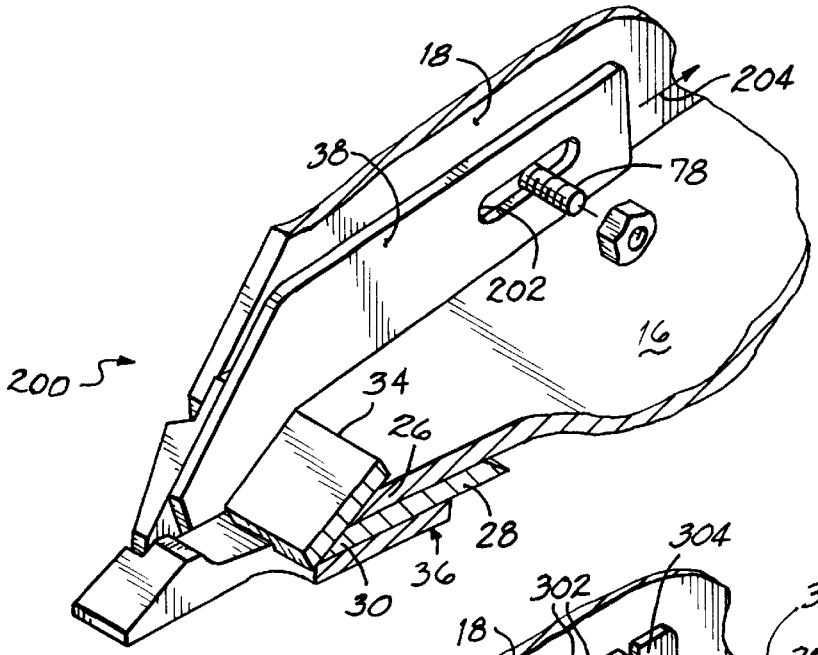
FIG. 7 is a view similar to FIG. 5 illustrating a protection assembly according to another alternative embodiment of the present invention.

A protection assembly 200 in accordance with an alternative embodiment of the present invention is shown in FIG. 7, where like reference numerals represent like parts to the embodiments of FIGS. 1–6. In this embodiment, the right and left positioning devices, such as the recesses or notches 84, 85 (FIG. 2) and the positioning members, such as the right and left mounting lugs 88, are eliminated so that the protection assembly 200 is variably positionable fore and aft relative to the bucket 12.

In particular, the right and left mounting brackets 38, 40 are each provided with an elongated slot 202 that is adapted to align with the respective apertures 76 formed in the bucket side walls 18, 22, and to receive the fasteners 78 therethrough for securement of the protection assembly 200 to the bucket 12. The protection assembly 200 is mounted on the bucket 12 with the base edge 26 and the cutting edge portion 30 of cutting edge 28 received in the elongated edge recess 74. Preferably, the protection assembly 200 is mounted on the bucket 12 so that at least one of the base edge 26 and/or the cutting edge 28 contacts the cover plate 34 substantially along its length to transfer the loads encountered during an excavation process. Alternatively, it will be appreciated that rearward movement of the protection assembly 200 may be prevented solely by frictional engagement of the fasteners 78 with the mounting brackets 38, 40.

It will be appreciated that the position of the protection assembly 200 relative to the bucket 12 will vary depending on the wear of the base edge 26 and the cutting edge 28. As these components wear through use, the protection assembly 200 is installed and positioned progressively in a rearward direction on bucket 12, as represented by arrow 204, so that at least one of the base edge 26 and/or cutting edge 28 contacts the cover plate 34 substantially along its length. Variable positioning of the protection assembly 200 fore and aft relative to the bucket 12 is accommodated by the elongated slots 202 formed in the mounting brackets 38, 40 that permit travel of the fasteners 78 within the slots 202. In this way, the protection assembly 100 is configured to be reliably installed on bucket 12 for protecting the base edge 26 and cutting edge 28 of the bucket assembly independent of the wear of these components.

Figure 8:
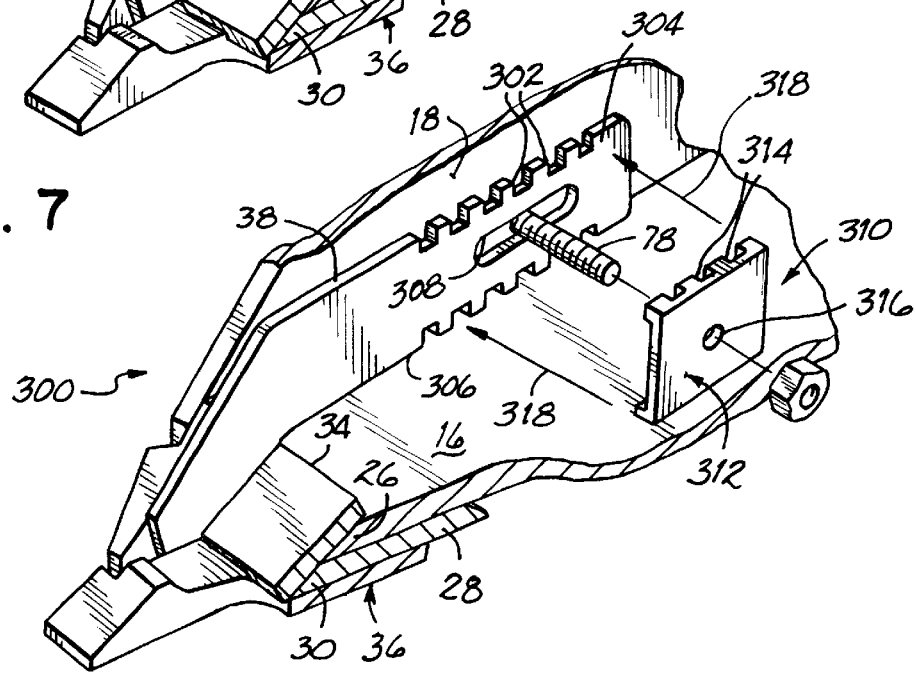
FIG. 8 is a view similar to FIG. 5 illustrating a protection assembly according to yet another alternative embodiment of the present invention.

A protection assembly 300 in accordance with another alternative embodiment of the present invention is shown in FIG. 8. In this embodiment, the mounting brackets 38, 40 are each provided with a series of equally spaced notches 302 formed along upper and lower edges 304, 306, respectively, of the mounting brackets 38, 40 and elongated slots 308 that are adapted to align with the respective apertures 76 formed in the bucket side walls 18, 22. A locking member 310, preferably in the form of a locking plate 312, includes a series of equally spaced teeth 314 that extend outwardly from the locking plate 312 and are adapted to be received within aligned notches 302 formed on the mounting brackets 38, 40. Each locking plate 312 includes a mounting aperture 316 that is adapted to receive one of the respective fasteners 78.

In use, the protection assembly 300 is preferably installed on the bucket 12 with at least one of the base edge 26 and/or the cutting edge 28 contacting the cover plate 34 substantially along its length. Variable positioning of the protection assembly 300 fore and aft relative to the bucket 12 is accommodated by the elongated slots 308 formed in the mounting brackets 38, 40 that permit travel of the fasteners 78 within the slots 308.

Thereafter, the locking plates 312 are positioned in cooperative engagement with the respective mounting brackets 38, 40, as indicated by arrow 318, so that the teeth 314 are received within aligned notches 302 and the fastener 78 is received with the mounting apertures 316. In this way, fore and aft movement of the protection assembly 300 after installation of the locking member 310 is prevented by positive engagement of the locking plates 312 with the respective mounting brackets 38, 40 and the fasteners 78. It will be appreciated that the notches 302 and teeth 314 may be replaced with other cooperating structures that provide positive engagement of the locking plates 312 with the mounting brackets 38, 40 without departing from the spirit and scope of the present invention.

Figure 9:
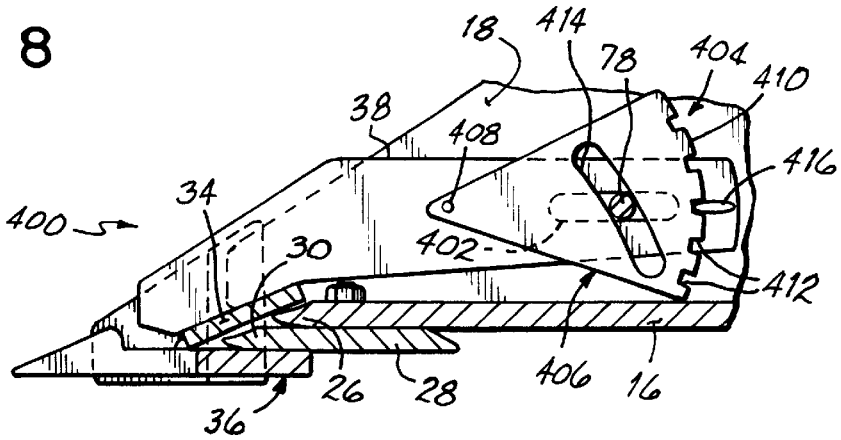
FIG. 9 is a view similar to FIG. 3 illustrating a protection assembly according to still yet another alternative embodiment of the present invention.

A protection assembly 400 in accordance with yet another alternative embodiment of the present invention is shown in FIG. 9. In this embodiment, the mounting brackets 38, 40 are each provided with an elongated slot 402 that is adapted to receive one of the respective fasteners 78 as described in detail above. Each mounting bracket 38, 40 further includes a locking member 404, preferably in the form of a locking plate 406, that is connected to the mounting brackets 38, 40 through pivot pins 408 in such a manner that the locking plates 406 are removably securable to the mounting brackets 38, 40 through the pivot pins 408 as described in detail below.

Each locking plate 406 has an arcuate edge 410, spaced rearwardly from the pivot pin 408, that includes a series of equally spaced notches 412. Each notch 412 is spaced rearwardly of and equidistantly from the pivot pins 408. Each locking plate 406 further includes an elongated cam slot 414 that communicates with the elongated slot 402 formed in each mounting bracket 38, 40, and is adapted to align with the mounting apertures 76 formed in the bucket side walls 18, 22 as the locking plates 406 are angularly repositioned relative to the mounting brackets 38, 40 about the pivot pins 408. The fasteners 78 are received in the elongated slots 402 of the mounting brackets 38, 40 and the cam slots 414 of the locking plates 406. As will be described in detail below, each mounting bracket 38, 40 includes at least one lug member 416 that extends outwardly and is adapted to be received in one of the aligned notches 412.

In use, the protection assembly 400 is preferably installed on the bucket 12 with at least one of the base edge 26 and/or the cutting edge 28 contacting the cover plate 34 substantially along its length. Variable positioning of the protection assembly 400 fore and aft relative to the bucket 12 is accommodated by the elongated slots 402 formed in the mounting brackets 38, 40 that permit travel of the fasteners 78 within the slots 402.

Thereafter, the locking plates 406 are positioned in engagement with the respective mounting brackets 38, 40 so that the pivot pins 408 are releasably engaged within apertures (not shown) formed in the respective mounting brackets 38, 40. Preferably, each pivot pin 408 includes a spring collar (not shown) that releasably engages with the apertures (not shown) formed in the mounting brackets 38, 40 to removably secure the locking plates 406 to the respective mounting brackets 38, 40. It will be appreciated that other structures for removably securing the locking plates 406 to the mounting brackets 38, 40, as understood by those skilled in the art, are possible without departing from the spirit and scope of the present invention.

The locking plates 406 are angularly repositionable relative to the respective mounting brackets 38, 40 prior to securement thereto so that the cam slots 414 are properly positioned to receive the fasteners 78 through the communicating slots 402, 414. During mounting of the locking plates 306 to the mounting brackets 38, 40, each lug members 416 is received in one of the aligned notches 412 formed on the arcuate edge 410 of the locking plates 406. In this way, fore and aft movement of the protection assembly 400 after installation of the locking member 404 is prevented by positive engagement of the locking plates 406, and in particular the cam slots 414, with the fasteners 78.

INDUSTRIAL APPLICABILITY

Implement assembly 10 can be utilized to excavate earth, especially hard-packed virgin soil. The protection assembly 29 is attached to bucket 12 prior to the excavation process and provides several advantages. For example, the plurality of forwardly disposed teeth 66 of the protection assembly 29 facilitate the ability of implement assembly 10 to penetrate the ground and perform an excavating work function. In addition, the protection assembly 29 positions the base edge 26 and the cutting edge 28 within edge recess 74 to protect both edges from wear and tear during excavation. Protection of edges 28, 30 extends the life of the bucket 12 and reduces maintenance costs. Moreover, it should be understood that the protection assembly 29 can be easily removed from bucket 12 once the protection assembly 29 wears out or when use of the bucket 12 without teeth 66 is desired. Specifically, the mounting brackets 38, 40 and mounting lugs 88 can be detached from the upright side walls 18, 22 and bucket bottom wall 16, respectively, so the protection assembly 29 can be removed from bucket 12. When use of teeth 66 is desired, the protection assembly 29 can be reattached to bucket 12 in a manner as described above so that the protection assembly 29 is consistently positioned at the same location on the bucket 12 regardless of the amount of wear on the base edge 26 or the cutting edge 28. This assures proper alignment of the mounting apertures 42 and 76 for secure attachment of the protection assembly 29 to the bucket 12. The positioning devices 80,82, 84, 85 and 88 prevent rearward, upward and downward movement of the protection assembly 29 when bucket 12 is used for excavating, especially in hard-packed virgin soil.

Alternatively, the protection assemblies 200, 300 and 400 are variably positionable fore and aft relative to the bucket 12 for protecting the base edge 26 and cutting edge 28 of the bucket assembly independent of the wear of these components. Locking member 310 prevents fore and aft movement of protection assembly 300 through positive engagement of the locking plates 312 with respective mounting brackets 38, 40 and the fasteners 78. Locking member 404 prevents fore and aft movement of protection assembly 400 through positive engagement of the locking plates 406 with the fasteners 78.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

Other aspects and features of the present invention can be obtained from a study of the drawings, the disclosure, and the appended claims.

What is claimed is:

1. A protection assembly for protecting a bucket of a work machine having a pair of upright side walls, at least one side wall including a mounting aperture formed therein, and a bottom wall extending between the upright side walls and terminating in a base edge subject to wear, and a cutting edge subject to wear and being attached to an underside of the bucket bottom wall adjacent the base edge, the protection assembly comprising:

a digging plate adapted to be positioned adjacent an underside of the cutting edge;

a cover plate operatively connected to the digging plate to form an elongated edge recess adapted to receive the base edge and the cutting edge;

at least one first positioning device adapted to be operatively connected to the bucket bottom wall;

at least one second positioning device operatively associated with at least one of the digging plate and the cover plate for engaging the first positioning device to position the edge recess relative to the base edge and the cutting edge; and at least one mounting bracket positioned adjacent an end of the elongated edge recess and configured to reside adjacent at least one upright bucket side wall, each mounting bracket having a mounting aperture adapted to register with the mounting aperture formed in the bucket side wall.

2. The protection assembly of claim 1, further comprising a plurality of teeth forwardly disposed along the digging plate.

3. The protection assembly of claim 1, wherein the first positioning device comprises an elongated lug member extending forwardly from the base edge of the bucket bottom wall.

4. The protection assembly of claim 3, wherein the second positioning device comprises a recess formed in the cover plate that is operable to receive and engage a forwardly extending portion of the lug member.

5. The protection assembly of claim 4 further comprising at least one retaining member operatively connected to at least one of the digging plate and cover plate for forming a rearwardly facing throat with the recess in the cover plate to receive the forwardly extending portion of the lug member.

6. The protection assembly of claim 1 further comprising a fastener extending through the mounting aperture formed in the bucket side wall and mounting bracket to secure the protection assembly to the bucket.

7. The protection assembly of claim 3 further comprising:

a lug plate operatively connected to the lug member; and an elongated pin operatively connected to the lug plate and registered to pass through the mounting aperture formed in the mounting bracket and bucket side wall.

8. The protection assembly of claim 4, wherein the bucket bottom wall includes at least one mounting aperture formed adjacent at least one side wall, and further wherein the lug member includes a pin adapted to be received within the mounting aperture.

9. The protection assembly of claim 8, wherein the lug member includes a mounting aperture adapted to register with the mounting aperture formed in the bucket bottom wall.

10. The protection assembly of claim 9 further comprising a fastener extending through the mounting aperture formed in the lug member and the mounting aperture formed in the bucket bottom wall to secure the lug member to the bucket bottom wall.

11. The protection assembly of claim 1 further including at least one end brace, the end brace operably connected to an opposite end of at least one of the digging plate and the cover plate.

12. A protection assembly for protecting a bucket of a work machine having a pair of upright side walls, each including a mounting aperture formed therein, and a bottom wall extending between the upright side walls and terminating in a base edge subject to wear, the protection assembly comprising:

a digging plate adapted to be positioned adjacent an underside of the bucket bottom wall;

a cover plate operatively connected to the digging plate to form an elongated edge recess adapted to receive the base edge of the bucket;

a pair of spaced apart elongated lug members adapted to be operatively connected to the bucket bottom wall to extend forwardly from the base edge;

a pair of spaced apart recesses formed in the cover plate for receiving and engaging forwardly extending portions of the lug members to position the edge recess relative to the base edge of the bucket; and a pair of spaced apart mounting brackets positioned adjacent opposite ends of the elongated edge recess and configured to reside adjacent the upright bucket side walls, each mounting bracket having a mounting aperture adapted to register with the mounting aperture formed in each bucket side wall.

13. The protection assembly of claim 12, further comprising a cutting edge adapted to be detachably mounted to the underside of the bucket bottom wall adjacent the base edge, the elongated edge recess being dimensioned to receive the cutting edge and the base edge.

14. The protection assembly of claim 12 further comprising a pair of spaced apart retaining members operatively connected to at least one of the digging plate and cover plate for forming a rearwardly facing throat with the recess in the cover plate to receive the forwardly extending portion of the lug member.

15. The protection assembly of claim 12 further comprising:

a lug plate operatively connected to each of the lug members; and an elongated pin operatively connected to each lug plate and registered to pass through the mounting aperture formed in each mounting bracket and bucket side wall.

16. An implement assembly, comprising:

a bucket having a pair of upright side walls, each including a mounting aperture formed therein, and a bottom wall extending between the upright side walls and terminating in a base edge subject to wear, a first plate adapted to be positioned adjacent an underside of the bucket bottom wall;

a second plate operatively connected to the first plate to form an elongated edge recess adapted to receive the base edge of the bucket;

a plurality of teeth extending forwardly from at least one of the first and second plates;

a pair of spaced apart first positioning devices operatively connected to the bucket bottom wall;

a pair of spaced apart second positioning devices operatively associated with at least one of the first and second plates for engaging the pair of first positioning devices to position the edge recess relative to the base edge of the bucket; and a pair of spaced apart mounting brackets positioned adjacent opposite ends of the elongated edge recess and configured to reside adjacent the upright bucket side walls, each mounting bracket having a mounting aperture adapted to register with the mounting aperture formed in each bucket side wall.

17. A protection assembly for protecting a bucket of a work machine having a pair of upright side walls, at least one side wall including a mounting aperture formed therein, and a bottom wall extending between the upright side walls and terminating in a base edge subject to wear, the protection assembly comprising:

a cutting edge being attached to an underside of the bucket bottom wall adjacent the base edge;

a digging plate adapted to be positioned adjacent an underside of the cutting edge;

a cover plate operatively connected to the digging plate to form an elongated edge recess adapted to receive the base edge and the cutting edge; and at least one mounting bracket positioned adjacent an end of the elongated edge recess and configured to reside adjacent at least one upright bucket side wall, the mounting bracket having a mounting aperture adapted to register with the mounting aperture formed in the bucket side wall.

18. The protection assembly of claim 17, further comprising a plurality of teeth forwardly disposed along the digging plate.

19. The protection assembly of claim 17 further comprising a fastener extending through the mounting aperture formed in the bucket side wall and mounting bracket to secure the protection assembly to the bucket.

20. The protection assembly of claim 19 wherein the mounting aperture formed in the mounting bracket comprises an elongated slot.

21. The protection assembly of claim 20 further comprising a locking member operatively cooperating with the mounting bracket and the fastener to variably position the protection assembly relative to the bucket.

22. The protection assembly of claim 21, wherein the mounting bracket has a plurality of notches formed therein, and the locking member comprises a locking plate having a plurality of teeth extending outwardly therefrom and operable to be received within respective notches of the mounting bracket.

23. The protection assembly of claim 22, wherein the locking plate has a mounting aperture adapted to receive the fastener.

24. The protection assembly of claim 21, wherein the mounting bracket has a lug member extending outwardly therefrom, and the locking member comprises a locking plate operatively connected to the mounting bracket and having a plurality of notches formed therein operable to receive the lug member.

25. The protection assembly of claim 24 wherein the locking plate is angularly repositionable relative to the mounting bracket.

26. The protection assembly of claim 24, wherein the locking member has a mounting aperture adapted to receive the fastener.

27. The protection assembly of claim 24, wherein the mounting aperture comprises an elongated slot.

* * * * *